United States Patent [19]

Sanford

[11] 4,187,680

[45] Feb. 12, 1980

[54] OIL WELL PUMP DRIVE

[76] Inventor: George A. Sanford, 300 E. Kansas, Arkansas City, Kans. 67005

[21] Appl. No.: 914,577

[22] Filed: Jun. 12, 1978

[51] Int. Cl.[2] ..... F16D 31/00; F15B 15/22

[52] U.S. Cl. ..... 60/369; 60/371; 60/381; 60/382; 60/383

[58] Field of Search ..... 60/369, 371, 372, 381, 60/382, 383; 92/110, 117, 137

[56] References Cited

U.S. PATENT DOCUMENTS

| | | | |
|---|---|---|---|
| 2,550,925 | 5/1951 | Weimar | 92/110 |
| 2,560,285 | 7/1951 | Habenicht | 60/372 |
| 2,645,899 | 7/1953 | Aller et al. | 60/372 |
| 3,482,399 | 12/1969 | Lawson | 60/382 |

*Primary Examiner*—Edgar W. Geoghegan

*Attorney, Agent, or Firm*—Robert E. Breidenthal

[57] ABSTRACT

An oil well pump drive including a drive unit that is hydraulically actuated by a double-acting hydraulic cylinder to reciprocate vertically. An endless chain is entrained over vertically spaced sprockets carried by the unit, with one flight of the chain anchored against vertical movement and the other flight is secured to the pump polish rod so that the vertical motion imparted to the polish rod is double that hydraulically imparted to the drive unit. The polish rod load on the chain is opposed by a counterweight connected thereto by a chain extending over an elevated pulley. The output of the hydraulic pump supplying the hydraulic cylinder is cam controlled so that the motion of the drive unit is smoothly decelerated and accelerated as the unit approaches and moves from the upper and lower limits of its movement.

14 Claims, 14 Drawing Figures

FIG. 1
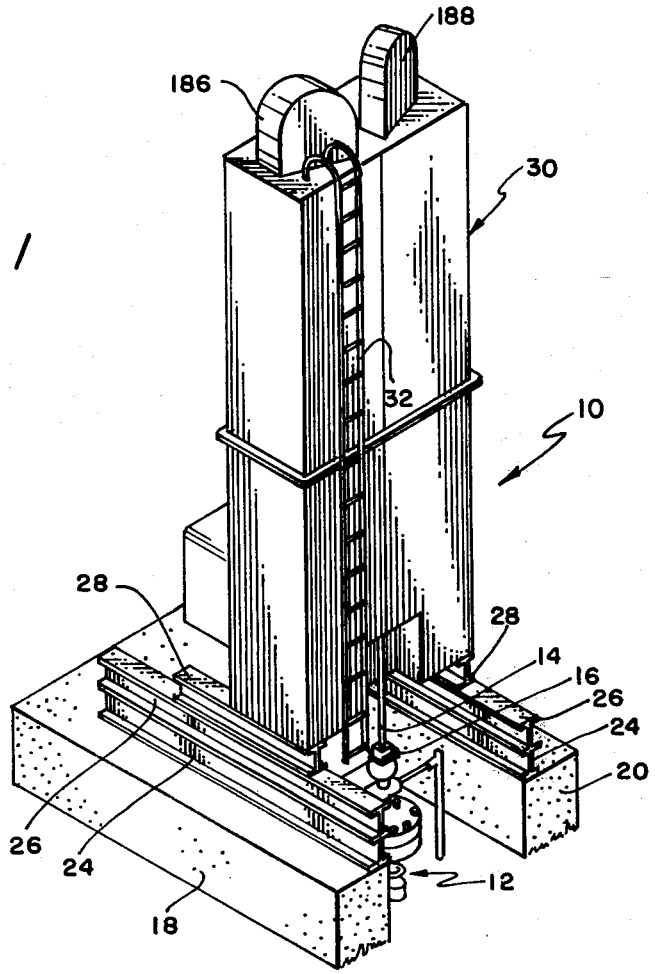
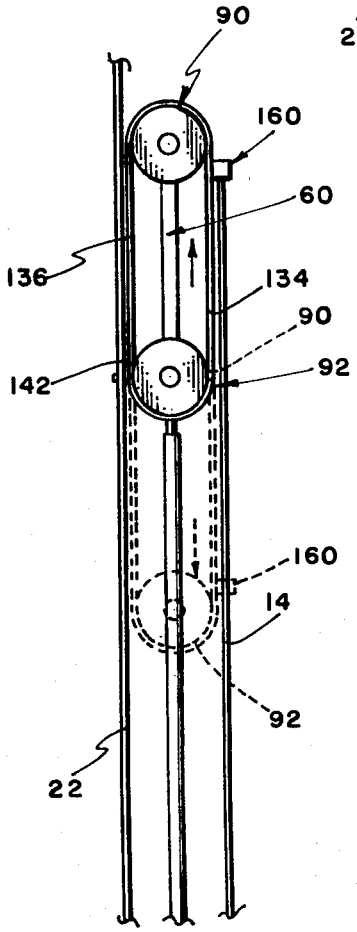
FIG. 2

172
176
5
94
90
5
70
160
82
80
22
80
72
82
6
134
136
98
6
142
92
176
180
12
18

94
120
124
110
122
124

FIG. 6
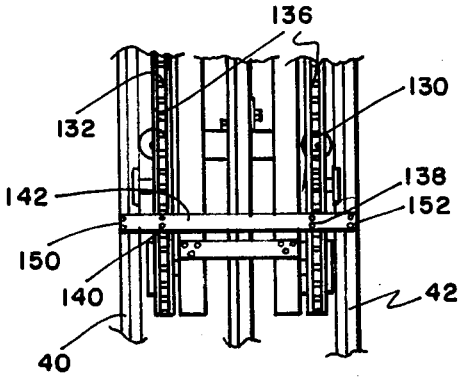
FIG. 7
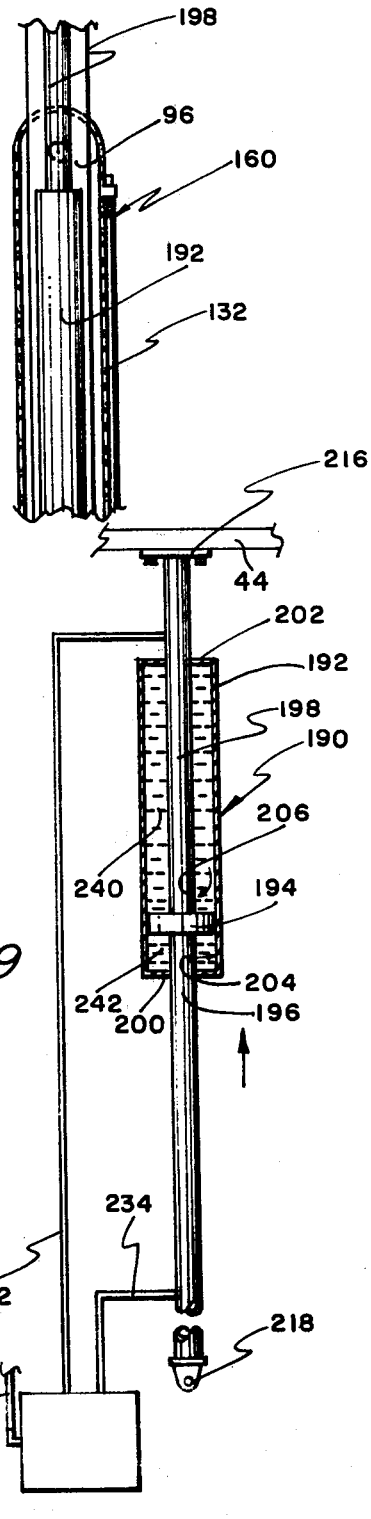
FIG. 8
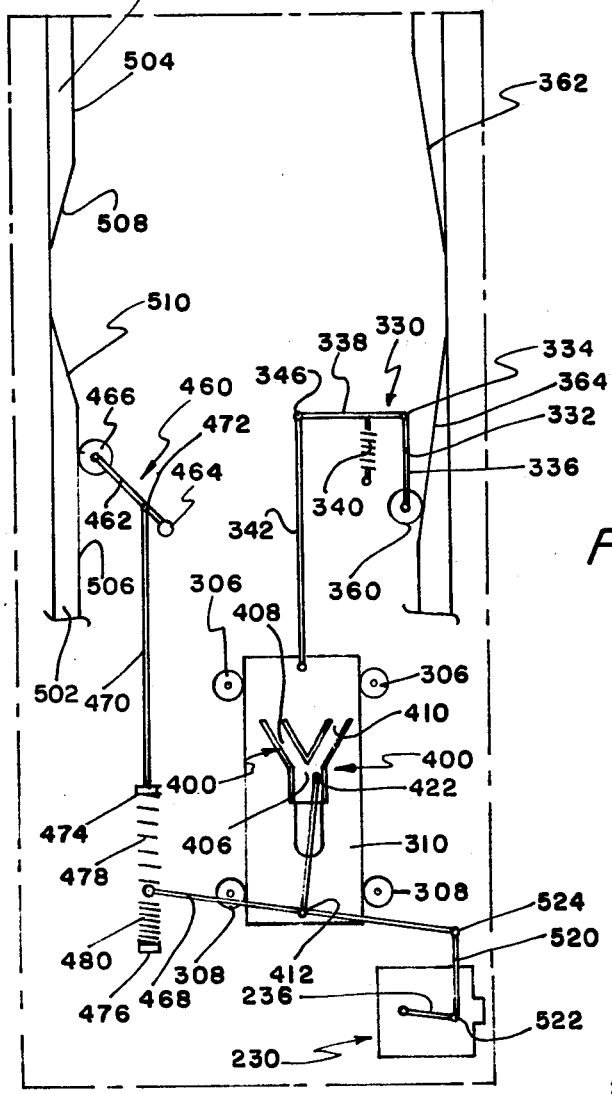
FIG. 9

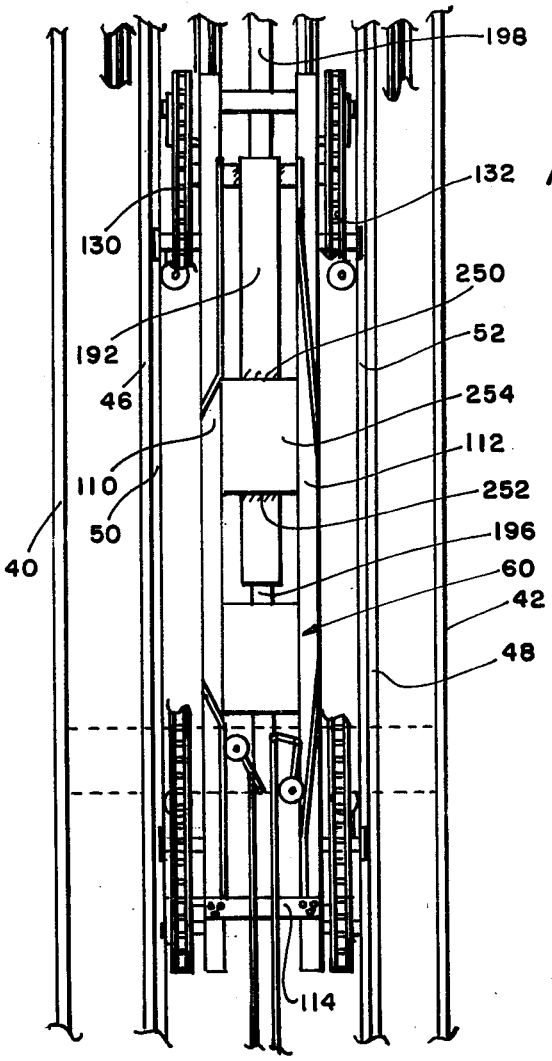
FIG. 11
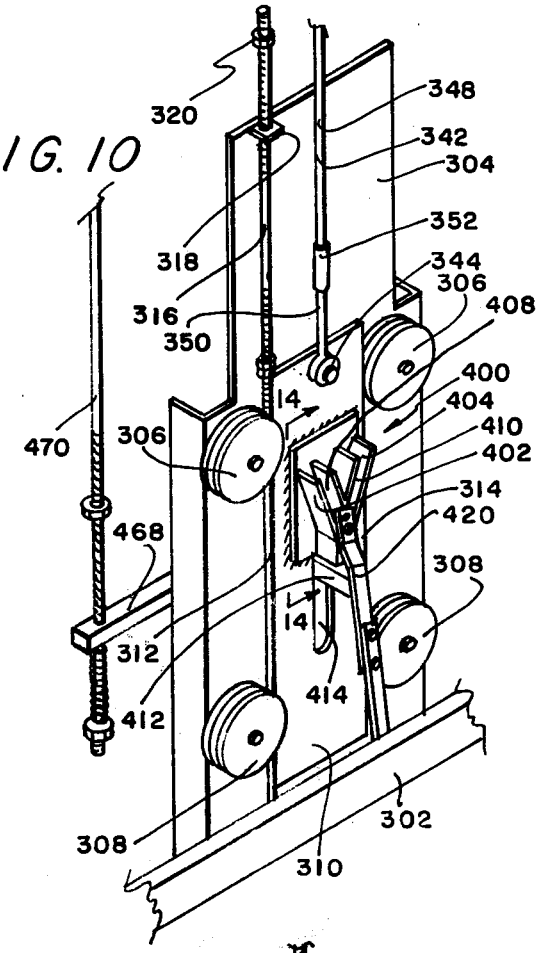
FIG. 10
FIG. 12
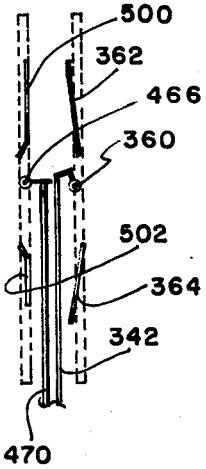
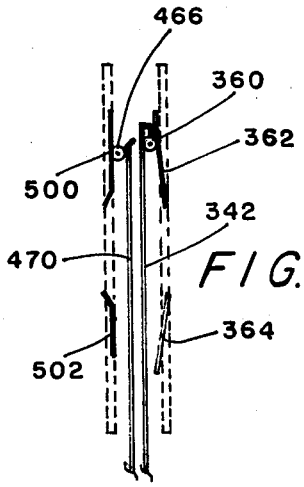
FIG. 13
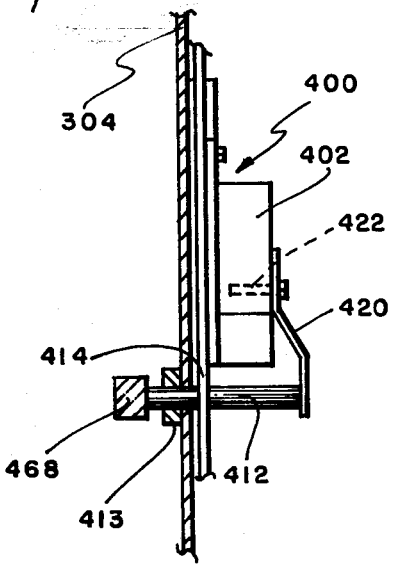
FIG. 14

OIL WELL PUMP DRIVE

The present invention relates to new and useful improvements in systems for operating oil well pumps, and more particularly pertains to a hydraulically actuated, vertically reciprocable motion doubling unit, with the motion hydraulically imparted to the unit being automatically controlled to reduce the magnitude of its accelerations adjacent the upper and lower limits of its travel.

The principal object of the invention is to provide apparatus for vertically reciprocating the polish rod of an oil well pump such that the stroke is of sufficiently great length to reduce the likelihood of gas locks as well as to realizing other well known advantages of a long stroke, and such that the motion of the polish rod and of parts movable therewith is subjected to accelerations of minimal magnitude in relation to stroke length and the number of strokes per minute, whereby working loads, wear and material fatigue are minimized.

Another important object of the invention is to provide apparatus in accordance with the above object which can be conveniently housed against weather to reduce maintenance and enable an enhanced appearance.

Broadly, one aspect of the invention involves an oil well pumping system comprising a frame adapted to be fixedly mounted at a wellhead, a unit mounted on the frame for vertical reciprocation between upper and lower positions, said unit having vertically spaced upper and lower sprockets mounted thereon for rotation about parallel horizontal axes, an endless chain extending between and entrained over said sprockets to define front and rear chain flights, said chain being fixedly secured to the frame against vertical movement at a position along the rear flight of the chain in an arrangement such that the upper and lower sprockets are nearest the position of chain securance when the unit is in its lower and upper positions respectively, polish rod attachment means carried by the chain for enabling attachment of the latter to a well pump polish rod, said attachment means being carried by the chain at a location along the front flight thereof in an arrangement such that the lower and upper sprockets are nearest the location of the attachment means when the unit is in its lower and upper positions respectively, counterweight connection means carried by the chain at a position adjacent the location of the polish rod attachment means for enabling connection of the chain to a counterweight structure, and hydraulic means including a double-acting cylinder and piston rod combination for powering vertical reciprocation of the unit relative to the frame between its upper and lower positions.

Another broad aspect of the invention involves in the combination of a reversible and variable output hydraulic pump operatively connected to a hydraulic motor to reciprocate a driven unit between first and second positions relative to a mount therefor, wherein said pump includes a control element movable in forward and reverse directions from a neutral position in an arrangement such that the rate at which the unit is driven toward its first and second positions is a function of the displacement of the control element in the forward and reverse directions respectively from its neutral position, an improved means operatively connected to the control element for respectively decelerating and accelerating movement of the unit as it approaches and departs from each of its positions, said improved means comprising a Y-shaped cam track mounted to reciprocate between on and off positions, said Y-shaped track including first and second arms inclined to each other from a juncture thereof, said Y-shaped cam track normally being disposed in its on position, cam means operatively connecting the unit, the mount of the unit and the Y-shaped cam track for moving the latter respectively toward and away from its off position as the unit approaches and departs from each of its recited positions, cam follower means engaging said Y-shaped cam track and operatively connected to the control element to move the latter respectively in the forward and reverse direction as the cam follower follows the first and second arms of the Y-shaped cam track from their juncture, and means for urging the cam follower respectively toward the first and second arms as the unit travels toward its first and second positions.

Various other important objects and features of the invention will become apparent during the ensuing description of a preferred embodiment of the invention, the same being given in conjunction with the accompanying drawings, wherein:

FIG. 1 is a isometric view of the housed oil well pumping system;

FIG. 2 is a side view, diagrammatic in character, illustrating in particular the motion doubling feature of the drive unit, the same being shown in full lines in its upper position and in dashed outline in its lower position;

FIG. 6 is a sectional detail view taken upon the plane of the section line 6—6 in FIG. 4 showing the anchoring attachment of the chains to the support frame;

FIG. 7 is a fragmentary elevational detail view taken on the plane of the line 7—7 in FIG. 3 showing the relationship of the polish rod hanger and the hydraulic cylinder with the latter at the upper end of its travel;

FIG. 8 is a schematic view of the cam means for controlling the operation of the reversible, variable volume hydraulic pumping unit;

FIG. 9 is a diagrammatic illustration of the hydraulic system including the mounting of the cylinder in movable fashion on the fixed piston rods;

FIG. 10 is an enlarged isometric detail view of a portion of the cam control means shown in FIG. 8;

FIG. 11 is a fragmentary rear view of the apparatus to illustrate particularly another portion of the cam control means shown in FIG. 8;

FIGS. 12 and 13 are diagrammatic views illustrating operation of the cam means shown in FIG. 11 during different portions of the reciprocating cycle; and, FIG. 14 is a sectional detail view taken on the plane of the line 14—14 in FIG. 10.

Figure 3:
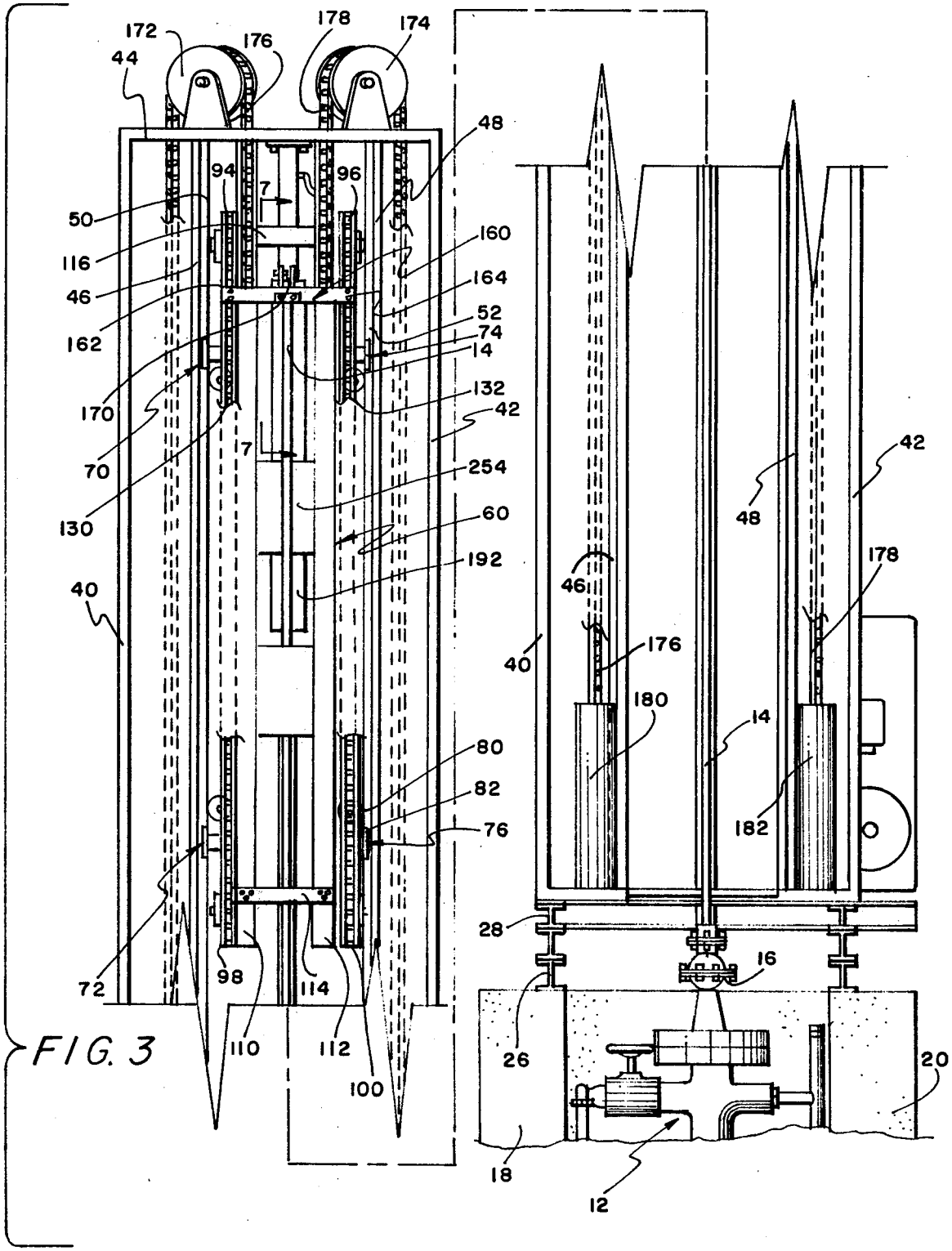
FIG. 3 is an expanded front view of the apparatus with the housing removed to show the internal structure of the same.

Referring now to the drawings, wherein like numerals designate like parts throughout the various views, the reference numeral 10 designates the pumping system generally.

The system 10 is disposed at the site of a conventional wellhead 12 that is operatively associated with a conventional downhole reciprocating oil well pump (not shown) connected by sucker rods (also not shown) to a polish rod 14 that vertically reciprocates through a packing gland 16 at the top of the wellhead to actuate the oil well pump. Except for the greater length of the polish rod 14 and the correspondingly greater length of the stroke of the pump practically realizable by the system 10, the apparatus thus far described, apart from the system 10 itself, is entirely conventional and well known in the art.

The pumping system comprises a sturdy ground supported foundation that includes a pair of spaced platforms 18 and 20 that extend above the surface of the ground and which are disposed on opposite sides of the wellhead 12. The foundation platforms 18 and 20 can be of any material commonly used for foundations for oil well pumping units such as reinforced concrete or preservative treated hardwood and the like.

The system 10 includes a fixed vertical frame 22 mounted on the foundation platforms 18 and 20 to extend vertically above the wellhead 12, with the mounting of the frame 22 preferably including load distributing pairs of steel "I" beams 24, 26 and 28, as shown. The frame 22, beams 24, 26 and 28, and the platforms are suitably secured to each other by conventional means, not shown.

The steel frame 22 is concealed from view in FIG. 1 by a multi-section steel housing structure that is assembled upon and mounted on the frame 22 to cover the top and sides thereof. The housing 30 in turn carries an external ladder 32 enabling workers easy access to the top of the housing 30 and to means, not shown, by which separable sections of the housing 30 are attached to the frame 22 whereby such sections can be removed to afford access to the interior of the housing 30 and to operating components of the system 10 housed therein yet to be described. The details of the housing 30 and its mode of attachment to the frame 22 are essentially conventional and are deemed well within the skill of the art and accordingly will not be dealt with in detail herein.

The frame 22 includes upstanding side walls or members 40 and 42 that are securely joined at their upper ends by a top wall 44. The frame 22 additionally includes a guide means constituted of a pair of spaced vertical guide members 46 and 48 disposed between and securely fastened thereto as well as to the top wall 44. The members 46 and 48 have vertical ribs 50 and 52 fixed thereto which project toward each other.

Proceeding now to the operating components of the system 10, the latter comprises a vertically elongated drive unit 60 mounted for vertical reciprocation within the frame 22, the same being guided for vertical movement between the members 46 and 48 by four sets of antifriction means operatively associated with the guide ribs 50 and 52. The antifriction sets are indicated at 70, 72, 74 and 76, with the sets 70 and 72 being carried respectively adjacent the upper and lower ends of the drive unit 60 for coaction with the rib 50, and with the sets 74 and 76 being carried respectively adjacent the upper and lower ends of the drive unit 60 for coaction with the rib 52. Since each of the sets 70, 72, 74 and 76 is essentially identical to each other, a detailed description of the set 76 will suffice for all. The antifriction set 76 includes three rollers mounted for rotation on one side of the drive unit 60. One of such three rollers is designated at 80 and the same is in rolling engagement with the edge of the rib 52 nearest the drive unit 60. The remainder of the three rollers is constituted of a pair of rollers designated at 82 that are mounted for rotation on the drive unit 60 and arranged to make rolling contact with the front and rear sides of the rib 52. The rearmost roller of the pair 82 is hidden from view in FIG. 3 by the foremost of the pair.

Means subsequently to be described is provided for actuating vertical reciprocation of the drive unit 60 between upper and lower positions.

Upper and lower pairs of chain sprockets 90 and 92 are respectively mounted on the drive unit 60 respectively adjacent its upper and lower ends. The upper pair of sprockets 90 consists of sprockets 94 and 96, with the lower pair of sprockets 92 comprising sprockets 98 and 100. As clearly shown in FIG. 3, the sprockets 94 and 98 are disposed adjacent the guide rib 50 at the left side of the drive unit 60, with the sprockets 96 and 100 being disposed on the righthand side of the unit 60 adjacent the guide rib 52. The upper sprockets 94 and 96 are in alignment with each other and are arranged to rotate about a horizontal axis. The lower pair of sprockets 98 and 100 are also in axial alignment about an axis parallel to and directly below the axis of the sprockets 94 and 96.

Figures 4, 5:
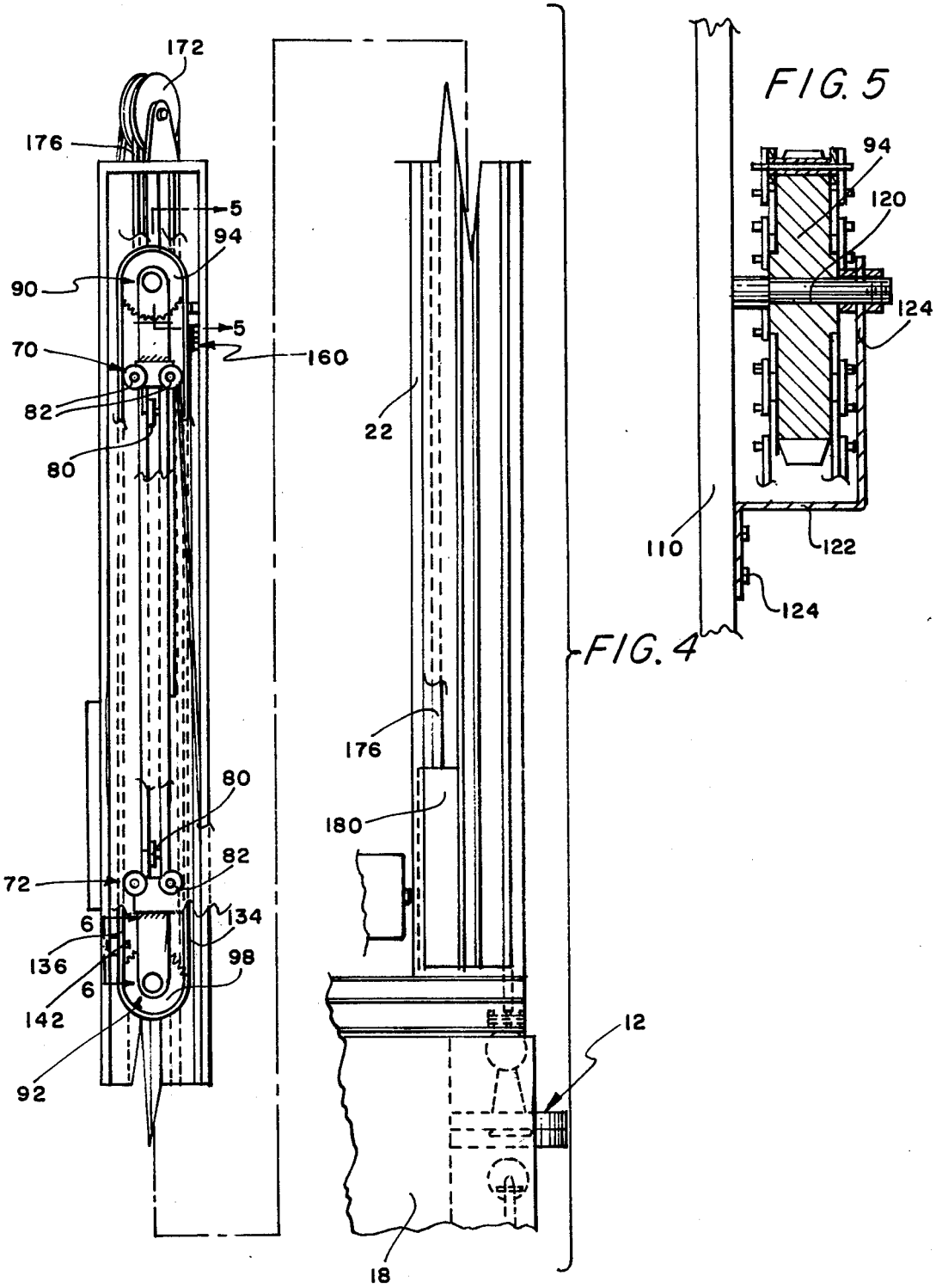
FIG. 4 is a side view of the apparatus corresponding to FIG. 3.
FIG. 5 is a sectional detail view taken upon the plane of the section line 5—5 in FIG. 4, partially illustrating one of the upper traveling sprockets and its mount on the drive unit.

The drive unit 60 includes a pair of elongated vertical steel members 110 and 112 that are rigidly secured together in spaced relationship by cross pieces indicated at 114 and 116. The sprockets 94 and 98 are mounted for rotation on the drive unit member 110, while the sprockets 96 and 100 are mounted for rotation on the drive unit member 112. Since all the sprockets 94, 96, 98 and 100 are mounted upon their respective drive unit members in essentially the same way, the mounting of the sprocket 94 on the drive unit member 110 (see FIG. 5) will suffice for all. A stub axle 120 has one end fixedly secured to the member 110, and has its other end braced, as shown, by a bracket 122 that is fastened to the member 110 as shown at 124, such bracket 122 including a leg 124 that is parallel to and spaced from the member 110. The sprocket 94 is mounted for rotation on the axle 120 intermediate the member 110 and the bracket leg 124. If desired or deemed expedient, antifriction roller bearing means, not shown, can be interposed between the sprocket 94 and the axle 120.

Heavy duty endless roller chains 130 and 132 are respectively entrained over the sprockets 94 and 98, and sprockets 96 and 100 in an arrangement defining forward and rear vertical flights of such chains 134 and 136. The rear flights 136 of the pair of chains are exposed to view in FIG. 6 wherein it will be seen that the chains 130 and 132 are respectively secured at 138 and 140 to an anchor strap 142 that is in turn fixedly anchored to the frame members 46 and 48 at 150 and 152. Means designated at 160 has its opposite ends rigidly attached to the front flights 134 of the chains 130 and 132 respectively at 162 and 164. Such means, as will be explained in greater detail later, serving to connect the chains to the upper end of the polish rod 14 and to a counterweight system are yet to be described.

Referring now to FIG. 2, the full line position shown of the drive unit 60 is such that the same is in its upper position in which case the lower sprockets 92 are closely adjacent the anchor strap 142, at which time the polish rod support means 160 is closely adjacent the upper sprockets 90 as shown. In other words, the relationship of the apparatus as thus far described is such that when the drive unit 60 is in its upper position, the lower end of the rear chain flight 136 is at the anchor strap 142 location on the frame 22, and the polish rod support means 160 is adjacent the upper end of the front chain flight 134. When the drive unit 60 is lowered to its lowermost position shown in dashed outline in FIG. 2, the anchor strap 142 position is at the upper end of the rear chain flight 136, with the polish rod support means 160 being disposed at the lower end of the front chain flight 134. It is important to note that the downward movement of the polish rod support means 160 is double that of the downward movement of the drive unit 60. In other words, during vertical reciprocation of the drive unit 60, the polish rod support means 160 reciprocates in the same sense as the drive unit 60 but by twice the amount.

The means 160 includes a conventional device or polish rod clamp 170 centered between the chains 130 and 132 for detachable connection to the polish rod 14, whereby double the vertical motion of the drive unit 60 is imparted to the polish rod 14.

A pair of pulleys 172 and 174 are mounted on the frame top wall 44 about horizontal axes that are rearwardly convergent. A pair of elongated flexible elements 176 and 178, preferably are chains, as shown, have ends secured to the means 160 on opposite sides of the device 170, such elements being entrained over the pulleys 172 and 174 respectively and having their other ends fastened to a pair of counterweights 180 and 182 that are vertically reciprocable within the frame 22, the counterweight 180 being disposed between frame members 40 and 46 and the counterweight 182 being disposed between frame members 42 and 48. The convergent axes of the pulleys enable the counterweights being outboard of the frame guide members 46 and 48.

It will be appreciated that the top wall 44 is provided with suitable openings, not shown, for passage of the chains 176 and 178 therethrough. It will be noted that the top portion of the housing 30 is shaped to include elevated parts 186 and 188 accommodating and covering the pulleys 172 and 174 as well as the chains entrained thereover.

As thus far described, forced vertical reciprocation of the drive unit 60 positively forces the means 160 upwardly and downwardly by double the movement of the drive unit 60. Loads imposed on the means 160 during upward and downward drive unit 60 movement can be adjusted as desired by adjusting the mass of the counterweights, the latter being conventional in that each can be augmented or diminished as desired by adding or removing individual weight units (not shown).

Hydraulic means is provided for forcing vertical reciprocation of the drive unit 60 that includes a double-acting cylinder and piston combination designated generally at 190, the same comprising a vertical cylinder 192 within which a piston 194 is sealingly reciprocable. Hollow, oppositely extending piston rods 196 and 198 have their adjacent ends fixed to the piston 194 and respectively sealingly extend through walls 200 and 202 that close the lower and upper ends of the cylinder 192. The remote opposite ends of the hollow rods are closed, and at positions closely adjacent the piston 194, the rods 196 and 198 are respectively provided with ports 204 and 206. It is to be understood that the ported positions of the piston rods remain at all times within the cylinder 192. The closed upper end of the piston rod 198 is connected by means 216 to the top wall 44. The closed lower end of the piston rod 196 is provided with means 218 by which it is securely fastened to the frame 22.

A conventional reversible and variable pump and valving combination is designated generally at 230, and such combination can conveniently be such as employed as the pumping portion of a pump and motor combination marketed as a variable pump—fixed motor transmission by Sundstrand Hydro-Transmission; Division of Sundstrand Corporation. Suffice to say, the combination 230 has fluid lines 232 and 234 connected thereto, and includes a control lever 236 which controls the direction and rate at which hydraulic fluid is circulated in the lines 232 and 234. When the lever 236 is in its neutral position, no fluid is forced into or received through either of the lines 232 and 234, however, with movement of the lever 236 in one direction fluid is forced into the line 232 while a corresponding quantity is received from the line 234 with the rate determined by the amount of displacement of the lever from its neutral position. The converse is true with displacement of the lever 236 in the opposite direction, fluid is forced into the line 234 and removed from the line 232. For those unfamiliar with such equipment, reference should be made to Bulletin 9522-A dated January 1971 and Bulletin 9523-A dated December 1970, each titled *Typical Heavy Duty Variable Pump—Fixed Motor Transmission Schematic*, published by Sundstrand Hydro-Transmission Division of Sundstrand Corporation.

The line 232 connects to the hollow piston rod 198 and thence to the working chamber 240 of the cylinder 192 via the port 206, and in a similar manner the line 234 communicates with the working chamber 242. The arrangement is such that forward and reverse movement of the control lever 236 will hydraulically actuate forced vertical reciprocation of the cylinder 192 on the piston rods 196 and 198, with the rate of movement and acceleration of the cylinder being determined by the movements imparted to the control lever 236. With full deflections of the lever 236 in either direction, the cylinder will travel vertically at maximum velocity, however, accelerations suffered by the cylinder 192 can be reduced on effecting reversals by relatively gradual movement of the lever from one limiting position to the other.

The cylinder 192 is securely attached to the drive unit 60 by being welded at 250 and 252 to a plate 254 that is rigidly connected between the drive unit members 110 and 112, the arrangement being such that the cylinder 192 and the drive unit 60 move in unison.

Means will now be described that automatically actuate movements of the pump and valving control lever 236 in response to the position and direction of movement of the drive unit 60 so that the drive unit 60 is smoothly decelerated as it is in the vicinity of and approaches either of its upper and lower limits of travel and so that the drive unit 60 is smoothly accelerated at and as it moves away for an interval from its two limiting positions, and that the major portion of all vertical travel of the drive unit 60 is at substantially constant and optimum velocities; however, it will also be seen that the means are of such character as to place within the realm of mere engineering choice the particular character of position versus velocity plots individually for the upward and downward movements of the drive unit 60. As an example of the value of enabling such engineering design choice would be a situation wherein it might be desirable that the peak downward velocity of the drive unit 60 be greater than the peak upward velocity of the drive unit 60. Such means is designated generally at 300 and is shown in its entirety schematically in FIG. 8.

The stationary frame 22 includes a rigid cross piece 302 on which is securely mounted an upstanding bracket 304, on which in turn are rotatably mounted upper and lower spaced pairs of peripherally grooved guide rollers 306 and 308. A cam mounting plate 310 is mounted for vertical reciprocation relative to the bracket 304 by having its vertical parallel edges 312 and 314 rollingly received in the grooves of the members of the pairs of rollers 306 and 308.

The cam plate 310 (see FIG. 10) is normally in its lowermost position which is adjustable by the provision of a vertical rod 316 having its lower end fastened to the plate 310 and extending upward therefrom freely through an apertured ear 318 on the bracket 304. The rod 316 is threaded and a pair of nuts 320 are threaded on the rod 316 at a selected position thereon to engage the ear 318 and adjustably limit the downward travel of the plate 310. The purpose of the second pair of nuts 320 is to serve as a jam nut to prevent undesired migration of the other nut along the rod 316.

The plate 310 is normally at its lower position at which time the nuts 320 rest on the ear 318. Cam means designated at 330 are provided to raise the cam plate 310 to the position shown thereof in FIGS. 8 and 10 when the drive unit 60 is adjacent and at its upper and lower positions. The cam means 330 comprises a bell crank 332 pivotally secured at 334 to the frame 22, such crank including arms 336 and 338. Coiled tension spring means 340 connect the arm 338 to the drive unit 60 to yieldingly bias counterclockwise movement of the bell crank 332 as viewed in FIGS. 9, 11, 12 and 13. A vertical rigid link 342 has its lower end pivotally connected to the cam plate 310 at 344 and has its upper end pivotally connected to the free end of the arm 338 at 346. In the preferred construction the link 342 includes a pair of aligned sections 348 and 350 having spaced and oppositely threaded adjacent ends joined by an appropriately threaded coupling 352 whereby the overall length of the link can be adjusted by turning the coupling 352, it being understood that the threads are of sufficiently fine pitch so the coupling 352 will not inadvertently move from adjusted position.

The free end of the cam arm 332 has a roller 360 rotatably mounted thereon for coaction with a pair of spaced, upper and lower, and oppositely inclined cam plates 362 and 364 securely fastened on the drive unit 60 by means not shown in detail. When the cam plates 362 and 364 are disposed respectively above and below the roller 360 (as indeed they are throughout all the travel of the drive unit 60 except when the latter is adjacent its upper and lower positions), the latter is in the travel path of such plates, the arrangement being such that, as the drive unit 60 respectively approaches its upper and lower limiting positions, the cam plates 364 and 362 engage the roller 360 and by a camming action therewith progressively rock the bell crank 332 clockwise against the bias of the spring 340 as viewed in FIG. 8, whereby the cam plate 310 is progressively elevated by the link 342. The cam plates 362 and 364 are shown straight to illustrate the principles involved, and it is deemed well within the skill of the art that either one or both the cam plates 362 and 364 can be contoured if desired to modify the positional relationship of the drive unit 60 and the cam plate within a considerable range of latitude. It will be evident that a reversal of the described camming action occurs as the drive unit 60 moves from both of its limiting positions. It will also be noted that the nuts 320 and the link 342 limit the extent of the counterclockwise rocking of the bell crank 332 urged by the spring 340.

The cam plate 310 carries a machined cam structure 400 that includes a set of ribs 402 defining a set of grooves 404 therebetween of a Y-shape inclusive of a central stem 406 joined by a branch 408 that is upwardly inclined to the left and a branch 410 that is inclined to the right as viewed in FIGS. 8 and 10.

A shaft 412 is mounted by a bearing at 412 for rotation through the bracket 304 (see FIG. 14), such shaft extending freely through a vertical slot 414 in the cam plate 310. An arm 420 is fixed to one end of the shaft 412 and a cam follower 422 is fastened to the free end of the arm 420 in a position to project into the grooves 404 so as to cammingly coact with the facing surfaces of the ribs 402 defining the grooves 406, 408 and 410.

The arrangement is such, as thus far described, that when the plate 310 is raised by the cam means 330 at the extremes of the travel of the drive unit 60, the cam follower 422 is in the stem groove 406 at which time the shaft 412 is at or approximately at its neutral position. Lowering the cam plate 310 will then respectively cam clockwise or counterclockwise progressive rotation of the shaft 412 depending on whether the cam follower 422 is in the groove 410 or the groove 408. Thereafter raising the plate 310 will progressively rotate the shaft 412 to or approximately to its neutral position. For a reason subsequently to be apparent the upper end of the stem groove 406 is of sufficient width that the cam follower 422 is allowed sufficient freedom that the shaft 412 is free to oscillate to a limited extent on opposite sides of what may be considered the truly neutral position of the shaft 412.

Cam means designated generally at 460 is provided for yieldingly biasing counterclockwise and clockwise rotation of the shaft 412 as viewed in FIGS. 8 and 10 when the drive unit 60 is respectively adjacent its lower and upper positions. The cam means 460 comprises a lever 462 that is pivoted at one end 464 on the frame 22 and the roller 466 is mounted for rotation on the other end of the lever 462. A lever 468 is centrally fixed to the end of the shaft 412 opposite the arm 420 (see FIG. 14), so as to oscillate in unison with the shaft 412. The levers 462 and 468 are oppositely interconnected by an elongated rod 470 having its upper end pivoted to the lever 462 at 472. The lower end of the rod 470 slidingly extends through an aperture, not shown, provided in one end of the lever 468. A pair of stop collars 474 and 476 are fixed in spaced relation on the rod 470 above and below the position at which the rod 470 extends through the lever 468. A pair of coiled compression springs 478 and 480 embrace the rod 470 and are respectively disposed between the lever 468 and the stop collars 474 and 476. The arrangement is such that the springs 478 and 480 yieldingly urge the lever 468 towards a position on the rod 470 midway between the stop collars 474 and 476.

The cam means 460 also includes a pair of vertically spaced cam plates 500 and 502 securely mounted on the drive unit 60 for travel therewith. The cam plates 500 and 502 respectively include vertical surfaces 504 and 506, which surfaces respectively join oppositely inclined surfaces 508 and 510 of the cam plates 500 and 502.

The cam means 460 operates in such a manner that when the drive unit 60 is elevated to such an extent that the roller 466 engages the cam surface 506, the lever 462 is inclined upwardly to the left as shown in FIG. 8;

however, on ensuing downward movement of the drive unit 60 sufficient for the roller 466 to engage the cam surface 504, the lever 462 is inclined downwardly to the left. Such reversal of position occurs by reason of the spring 480 urging counterclockwise movement of the lever 462 until the roller 466 has rolled down a portion of the cam surface 510, after which time the lever 462 is free to assume a generally horizontal position until the roller 466 is engaged by the cam surface 508. The relationship of the parts when the lever 462 assumes its substantially horizontal position is shown in FIG. 12. The steepness of the cam surface 508 is sufficient to force downward movement of the roller 466 and consequent inclination of the lever 462 downwardly and to the left as the roller 466 eventually rolls on the surface 504.

The relationship of the parts when the roller 466 rolls upon the surface 504 is shown in FIG. 13.

The above action sequence is essentially reversed when the drive unit 60 is again raised so as to reposition the parts in their initial position shown in FIG. 8.

As thus far described, the cam means 330 and 460 cooperate in that the former raises the valve plate 310 until the cam follower is in the stem groove 406 at which point, depending upon the application of clockwise or counterclockwise bias to the shaft 412, relowering of the plate 310 will result in the cam follower 422 traveling respectively the groove 408 or the groove 410. The cam means 460 coacts to provide clockwise bias to the shaft 412 when the drive unit 60 is in the upper portion of its travel, and conversely applies counterclockwise bias when the drive unit is in the lower portion of its travel.

A link 520 has its opposite ends pivotally connected at 522 to the control lever 236 and at 524 to the end of the lever 468 opposite the rod 470, whereby the positioning of the control lever 236 is a function of the angular position of the shaft 412.

The operation of the control system will now be readily understood. Assume as an initial condition that the drive unit 60 is in its uppermost position so as to correspond to the relationship of the parts shown in FIG. 8. It will be noted that the cam follower 422 is biased to the right from a centralized position so that lowering of the cam plate 310 will cam the shaft 412 in a clockwise direction. It should be noted at this point that the relationship of the parts and their geometries are such that when the cam follower 422 is centralized with respect to the cam grooves 408 and 410, the control lever 236 is in its neutral position. It will therefore be appreciated that the displacement of the cam follower 422 slightly to the right of its neutral position forces the pivotal connection 522 slightly downward from the neutral position of the lever 236 whereupon hydraulic fluid is forced into the line 232 at a slow rate to indicate downward movement of the drive unit 60. Such initial slow downward movement of the drive unit 60 results in the bell crank 332 progressively urging downward movement of the cam plate 310 which in turn results in the cam means 400 progressively rocking the shaft 412 clockwise until the stop nuts 320 engage the tab 318. Such progressive rocking of the shaft 412 in a clockwise direction forces the pivot connection 522 downwardly to increase the rate of fluid introduction to the line 232 until the plate 310 reaches its lowermost position. The drive unit 60 will continue its downward movement at its maximum rate until the cam means 330 result in clockwise rotation of the bell crank 332 to again raise the plate 310 to its uppermost position. By the time the plate 310 reaches its uppermost position so that the cam follower is at the upper end of the stem groove 406, the cam means 460 biases the stem 412 in a counterclockwise direction so that the cam follower 422 passes through and to the left of its neutral position so as to raise the pivotal connection 522 sufficiently to commence introducing fluid at a slow rate into the line 234 and thereby initiate slow upward movement of the drive unit 60. It will be observed that in the same manner that the rate of fluid introduction to the line 232 was progressively increased rather than abruptly commenced at nearly maximum rate. The rate of fluid introduction is progressively diminished as the drive unit 60 approaches its lowermost position.

From the foregoing, the operation of the oil well pumping system will be fully understood by those conversant with the art. The invention is susceptible to numerous variation without departing from the spirit thereof, as for example, rather than being straight as shown, either one or both of the grooves 408 and 410 can be curved to change the rate of movement of the control lever 236 in relation to the movement of the drive unit 60. In this regard, it will be evident to the initiated that the rate of actuation of the lever 236 is a function of the degree of inclination of the cam grooves 408 and 410.

Attention is now directed to the appended claims for an appreciation of the scope of the invention.

I claim:

1. An oil well pumping system comprising a frame adapted to be fixedly mounted at a wellhead, a unit mounted on the frame for vertical reciprocation between upper and lower positions, said unit having vertically spaced upper and lower sprockets mounted thereon for rotation about parallel horizontal axes, an endless chain extending between and entrained over said sprockets to define front and rear chain flights, said chain being fixedly secured to the frame against vertical movement at a position along the rear flight of the chain in an arrangement such that the upper and lower sprockets are nearest the position of chain securance when the unit is in its lower and upper positions respectively, polish rod attachment means carried by the chain for enabling attachment of the latter to a well pump polish rod, said attachment means being carried by the chain at a location along the front flight thereof in an arrangement such that the lower and upper sprockets are nearest the location of the attachment means when the unit is in its lower and upper positions respectively, counterweight connection means carried by the chain at a position adjacent the location of the last recited means for enabling connection of the chain to a counterweight structure, and hydraulic means including a double-acting cylinder and piston rod combination for powering vertical reciprocation of the unit relative to the frame between its upper and lower positions.

2. The combination of claim 1, and counterweight structure comprising a pulley mounted on the frame at a position above the upper position of the unit for rotation about a horizontal axis, an elongated flexible element having first and second ends entrained over the pulley, said first end of the element being connected to the counterweight connection means, and a counterweight attached to the second end of the element.

3. The combination of claim 2, together with a housing carried by the frame disposed to cover the top and to enclose the sides of the frame, the unit, and the counterweight structure.

4. The combination of claim 1, wherein double-acting cylinder and position rod combination comprises a vertically disposed, elongated hydraulic cylinder having a piston longitudinally and sealingly reciprocable therein, oppositely extending elongated piston rods fixed at their adjacent ends to the piston and slidably extending through sealing means provided at the opposite ends of the cylinder in an arrangement such that fluid working chambers are defined within the cylinder on opposite sides of the piston, means including fluid passageway means in the piston rods for forcing hydraulic fluid into the chambers, alternately first one and then the other, while discharging piston displaced fluid from the other, whereby the cylinder is caused to reciprocate vertically on the piston and the piston rods, said piston rods being fixed to the frame at positions remote from the piston, and said cylinder being fastened to the unit for vertical reciprocation therewith.

5. The combination of claim 4, wherein said means for forcing fluid to the working chambers, alternately first one and then the other, includes fluid control means responsive to the direction of movement of and the position of the unit for varying the rate that fluid is forced into the working chambers in such a manner that the rate is respectively progressively diminished and progressively increased as the unit approaches and moves from its recited positions, whereby vertical accelerations of the reciprocating unit are reduced as well as loadings caused by such vertical accelerations.

6. The combination of claim 5, wherein the fluid control means includes a reversable and variable output hydraulic pump of the type that has a control element movable from a neutral position in one direction to increase the pump output delivered to one of the working chambers by an amount that progressively increases with displacement of said element in said one direction, with said control element being movable in a direction opposite said one direction to increase the pump output delivered to the other of the working chambers by an amount that progressively increases with displacement of said element in said opposite direction, and cam means interconnecting the unit and the frame and operatively connected to said element for moving said element alternately in opposite directions through its neutral position when the unit approaches, reaches and departs from its said upper and lower positions.

7. The combination of claim 6, wherein said cam means comprises a plate mounted for vertical reciprocation on the frame between upper and lower positions thereof, said plate normally being disposed in its upper position, a first cam means operable to move the plate into its upper position solely when the unit is adjacent its upper and its lower position, the arrangement being such that the plate is in lower position during a major proportion of the vertical movement of the unit with the plate being raised from and lowered to lower position respectively as the unit approaches and recedes from each of its positions, a Y-shaped cam track having first and second arms upwardly inclined from a juncture thereof carried by the plate, a cam follower operatively associated with the cam track, and means pivoted to the frame operatively connecting the pump control element for moving the element in one direction as the cam follower moves upwardly in one of said arms and to the opposite direction as the cam follower moves upwardly in the other arm, and cam means operative to yieldingly urge the cam follower toward the first and second arms respectively when the unit is adjacent its upper and lower positions.

8. For use with an oil well pump inclusive of a vertically reciprocable polish rod at a wellhead, an improved means for reciprocating the polish rod comprising an upright frame adapted to be rigidly mounted at the wellhead, a unit mounted on the frame for vertical reciprocation between upper and lower positions, said unit having vertically spaced upper and lower sprockets mounted thereon for rotation about parallel horizontal axes, an endless chain extending between and entrained over said sprockets to define front and rear chain flights, said chain being fixedly secured to the frame against vertical movement at a position along the rear flight of the chain in an arrangement such that the upper and lower sprockets are nearest the position of chain securance when the unit is in its lower and upper positions respectively, polish rod attachment means carried by the chain for attaching the chain to the polish rod, said attachment means being carried by the chain at a location along the front flight thereof in an arrangement such that the lower and upper sprockets are nearest the location of the attachment means when the unit is in its lower and upper positions respectively, counterweight connection means carried by the chain at a position adjacent the location of the polish rod attachment means for connecting the chain to one end of an elongated flexible element having its other end secured to a counterweight, a pulley mounted on the frame above the unit for rotation about a horizontal axis, said elongated element being entrained over the pulley intermediate its ends, and hydraulic means including a double-acting cylinder and piston rod combination for powering vertical reciprocation of the unit relative to the frame between its upper and lower positions.

9. Oil well pumping apparatus comprising an upright frame adapted to be rigidly mounted at a wellhead, a vertically elongated power unit mounted on said frame for vertical reciprocation between upper and lower positions, a lower pair of horizontally spaced and axially aligned sprockets mounted on and adjacent the lower end of the power unit for rotation in unison about a horizontal axis, an upper pair of horizontally spaced and axially aligned sprockets mounted on and adjacent the upper end of the power unit for rotation in unison about an axis directly above and parallel to the axis of the lower pair of sprockets, a pair of horizontally spaced, endless chains entrained over the upper and lower pairs of sprockets to define front and rear vertical flights of the chains, said chains having corresponding positions along their rear flights connected together and anchored to the frame, a cross piece connecting corresponding positions of the chains along their front flights in an arrangement that the cross piece is adjacent the lower pair of sprockets when the unit is in its lower position and the anchored position of the chains adjacent the upper pair of sprockets, means carried by the crosspiece between the chains adapted for connecting the same to a polish rod, a pair of pulleys mounted on the frame above the power unit, a pair of counterweights, a pair of elongated flexible elements entrained over the pulleys and having their opposite ends respectively secured to the counterweights and the front flights of the chains adjacent the crosspiece, and power means for vertically reciprocating the unit.

10. The combination of claim 9, together with a housing carried by the frame disposed to cover the top and to horizontally enclose the frame, the power unit, the pulleys and the counterweights.

11. The combination of claim 9, wherein the power means comprises a vertically disposed, elongated hydraulic cylinder having a piston longitudinally and sealingly reciprocable therein, oppositely extending elongated piston rods fixed at their adjacent ends to the piston and slidably extending through sealing means provided at the opposite ends of the cylinder in an arrangement such that fluid working chambers are defined within the cylinder on opposite sides of the piston, means including fluid passageway means in the piston rods for forcing hydraulic fluid into the chambers, alternately first one and then the other, while discharging piston displaced fluid from the other, whereby the cylinder is caused to reciprocate vertically on the piston and the piston rods, said piston rods being fixed to the frame at positions remote from the piston, and said cylinder being fastened to the unit for vertical reciprocation therewith.

12. The combination of claim 11, wherein said means for forcing fluid to the working chambers, alternately first one and then the other, includes fluid control means responsive to the direction of movement of and the position of the unit for varying the rate that fluid is forced into the working chambers in such a manner that the rate is respectively progressively diminished and progressively increased as the unit approaches and moves from its recited positions, whereby vertical accelerations of the reciprocating unit are reduced as well as loadings caused by such vertical accelerations.

13. In the combination of a reversible and variable output hydraulic pump operatively connected to a hydraulic motor to reciprocate a driven unit between first and second positions relative to a mount therefor, wherein said pump includes a control element movable in forward and reverse directions from a neutral position in an arrangement such that the rate at which the unit is driven toward its first and second positions is a function of the displacement of the control element in the forward and reverse directions respectively from its neutral position, an improved means operatively connected to the control element for respectively decelerating and accelerating movement of the unit as it approaches and departs from each of its positions, said improved means comprising a Y-shaped cam track mounted to reciprocate between on and off positions, said Y-shaped track including first and second arms inclined to each other from a juncture thereof, said Y-shaped cam track normally being disposed in its on position, cam means operatively connecting the unit, the mount of the unit and the Y-shaped cam track for moving the latter respectively toward and away from its off position as the unit approaches and departs from each of its recited positions, cam follower means engaging said Y-shaped cam track and operatively connected to the control element to move the latter respectively in the forward and reverse direction as the cam follower follows the first and second arms of the Y-shaped cam track from their juncture, and means for urging the cam follower respectively toward the first and second arms as the unit travels toward its first and second positions.

14. The combination of claim 13, including means for varying the spacing of the on and off positions of the Y-shaped cam track, and means for releasably fixing the spacing of the on and off positions.

* * * * *